US006406822B1

(12) United States Patent
Silence et al.

(10) Patent No.: US 6,406,822 B1
(45) Date of Patent: Jun. 18, 2002

(54) COLOR-BLIND MELT FLOW INDEX PROPERTIES FOR TONERS

(75) Inventors: Scott M. Silence, Fairport; Joo T. Chung, Webster; James M. Proper, Webster; Edward J. Gutman, Webster; James G. Stenzel, Rochester; Kip L. Jugle, Bloomfield; Yelena Shapiro, Rochester; James A. Winters, Alfred Station; Maria M. Barden, Fairport; John S. Walters, Pittsford, all of NY (US)

(73) Assignee: Xerox Corporation, Stamford, CT (US)

( * ) Notice: Subject to any disclaimer, the term of this patent is extended or adjusted under 35 U.S.C. 154(b) by 57 days.

(21) Appl. No.: 09/671,997

(22) Filed: Sep. 29, 2000

(51) Int. Cl.[7] ..... G03G 9/08
(52) U.S. Cl. ..... 430/45; 430/111.4; 430/137.2
(58) Field of Search ..... 430/106, 108, 430/137, 45, 111.4, 137.2

(56) References Cited

U.S. PATENT DOCUMENTS

| | | | |
|---|---|---|---|
| 3,590,000 A | 6/1971 | Palermiti et al. | |
| 3,847,604 A | 11/1974 | Hagenbach et al. | |
| 4,298,672 A | 11/1981 | Lu | |
| 4,338,390 A | 7/1982 | Lu | |
| 4,868,600 A | 9/1989 | Hays et al. | |
| 4,935,326 A | 6/1990 | Creatura et al. | |
| 4,937,166 A | 6/1990 | Creatura et al. | |
| 5,227,460 A | 7/1993 | Mahabadi et al. | |
| 5,545,501 A | 8/1996 | Tavernier et al. | |
| 6,177,221 B1 * | 1/2001 | Maniar et al. | 430/45 |

* cited by examiner

*Primary Examiner*—John Goodrow
(74) *Attorney, Agent, or Firm*—Oliff & Berridge, PLC; Eugene O. Palazzo

(57) ABSTRACT

At least three differently colored toners, designed for use together in forming a color image in an image developing device, have substantially the same melt flow index value. By substantially matching the melt flow index values of at least three toners of a set of toners, it has been found that the resultant color image has an overall excellent image quality, i.e., an excellent overall gloss level without any gloss banding. The toners may be made to have substantially the same melt flow index value in a carefully controlled process that includes forming a single toner by feeding at least one binder and at least one colorant into a mixing device to form a mixture, upon exit of the mixture from the mixing device, measuring a rheology property of the mixture with at least one monitoring device, and comparing the measured rheology property to a target property range that the measured rheology property must be within in order for the single toner to achieve the desired melt flow index value, wherein if the measuring indicates that the rheology property is outside of the target property range, feed amounts of the at least one binder or of the at least one colorant into the mixing device are adjusted, grinding the mixture, optionally together with a portion of one or more external additives to be added to the mixture, classifying the ground mixture, mixing the classified mixture with one or more external surface additives to obtain the single toner having the desired melt flow index value, and repeating the steps for each additional differently colored toner.

20 Claims, 1 Drawing Sheet

COLOR-BLIND MELT FLOW INDEX PROPERTIES FOR TONERS

BACKGROUND OF THE INVENTION

1. Field of Invention

This invention relates to a toners within a set of toners used in developing a color image, and a method of making the toners, which toners are made to have a matching melt flow index (MFI) value.

2. Description of Related Art

Historically, xerography has not been required to deliver prints of the same caliber as offset lithography. The offset lithography customer demands a level of print quality much higher than is available from conventional xerographic machines.

U.S. Pat. No. 5,545,501 describes an electrostatographic developer composition comprising carrier particles and toner particles with a toner particle size distribution having a volume average particle size (T) such that 4 $\mu$m<T<12 $\mu$m and an average charge (absolute value) pro diameter in femtocoulomb/10 $\mu$m (CT) after triboelectric contact with said carrier particles such that 1 fC/10 $\mu$m<$C_T$<10 fC/10 $\mu$m characterized in that (i) said carrier particles have a saturation magnetization value, $M_{sat}$, expressed in Tesla (T) such that $M_{sat}$>0.30 T, (ii) said carrier particles have a volume average particle size ($C_{avg}$) such that 30 $\mu$m <$C_{avg}$<60 $\mu$m, (iii) said volume based particle size distribution of said carrier particles has at least 90% of the particles having a particle diameter C such that 0.5 $C_{avg}$<C<2 $C_{avg}$, (iv) said volume based particles size distribution of said carrier particles comprises less than b % particles smaller than 25 $\mu$m wherein b=0.35 X $(M_{sat})^2$ X P with $M_{sat}$ saturation magnetization value, $M_{sat}$, expressed in T and P: the maximal field strength of the magnetic developing pole expressed in kA/m, and (v) said carrier particles comprise a core particle coated with a resin coating in an amount (RC) such that 0.2% w/w<RC<2% w/w. See the Abstract. Melt flow index properties and the need for matching such properties among different toners of a set of toners are not described.

Co-pending U.S. patent applications Nos. 09/520,439 pending; 09/520,437 (now U.S. Pat. No. 6,242,145) and 09/520,359 allowed, all filed Mar. 7, 2000, and each incorporated by reference herein in its entirety, describe toners and developers for particular use in devices utilizing hybrid scavengeless development, the toners including toner particles of at least one binder, at least one colorant, and optionally one or more additives, the toner exhibiting a charge per particle diameter (Q/D) of from −0.1 to −1.0 fC/$\mu$m with a variation during development of from 0 to 0.25 fC/$\mu$m and the distribution is substantially unimodal and possesses a peak width of less than 0.5 fC/$\mu$m, and the toner has a triboelectric charge of from −25 to −70 $\mu$C/g with a variation during development of from 0 to 15 $\mu$C/g following triboelectric contact with carrier particles. The developer of a mixture of carrier particles and the toner particles has a triboelectric value of from −35 to −60 $\mu$C/g, a charge distribution (Q/D) of from −0.5 to −1.0 fC/$\mu$m and the distribution is substantially unimodal and possesses a peak width of less than 0.5 fC/$\mu$m, preferably less than 0.3 fC/$\mu$m, and a conductivity of the developer ranges from $1\times10^{-11}$ to $10\times10^{-15}$ mho/cm as measured at 30 V. The method of forming the toner having controlled properties includes feeding at least one binder and at least one colorant into a mixing device at a feed ratio, upon exit of the mixture from the mixing device, monitoring one or more properties of the mixture with at least one monitoring device, wherein if the monitoring indicates that the one or more properties being monitored is out of specification, removing the monitored mixture from the method and adjusting the feed ratio by adjusting the feeding of the at least one binder or of the at least one colorant, thereby retaining in specification mixture in the method, grinding the in-specification mixture, optionally together with a portion of one or more external additives to be added to the mixture, classifying the ground in-specification mixture, and mixing the classified in-specification mixture with one or more external additives to obtain the toner having controlled properties.

While these co-pending applications describe a range of rheology or MFI for a single toner, no required relationship of such properties among a set of toners is described.

Co-pending U.S. patent application No. 09/520,360, filed Mar. 7, 2000 and incorporated by reference herein in its entirety, describes a toner and developer for use in an imaging system employing a magnetic brush developer unit. The toner contains at least one binder, at least one colorant, and preferably one or more external additives of one or more of silicon dioxide powder, untreated titanium dioxide powder and zinc stearate (in amounts of at least 0.1 percent by weight of the toner). The toner particles, following triboelectric contact with carrier particles, exhibit a charge per particle diameter (Q/D) of from 0.6 to 0.9 fC/$\mu$m and a triboelectric charge of from −20 to −25 $\mu$C/g. The toner particles preferably have an average particle diameter of from 7.8 to 8.3 microns. The toner is combined with carrier particles to achieve a developer, the carrier particles preferably having an average diameter of from 45 to 55 microns and including a core of ferrite substantially free of copper and zinc coated with a coating comprising a polyvinylidenefluoride polymer or copolymer and a polymethyl methacrylate polymer or copolymer.

What is still desired is a set of toners and developers that have excellent overall print quality, particularly with respect to gloss within and among the different colors of the developers and toners, and a method of making such toners.

SUMMARY OF THE INVENTION

It is an object of the present invention to provide a set of toners for developing a color image in which at least three, and preferably four, of the toners from the set each have substantially the same melt flow index property such that the developers containing such toners can achieve xerographically produced images having excellent gloss, color and image quality.

It is a further object of the invention to develop such toners and developers capable of producing such high quality color images when used in a development device that utilizes either a radiant fusing system or a roll fusing system.

It is a still further object of the invention to provide a method for manufacturing the toners and developers to consistently achieve the desired melt flow index value.

These and other objects of the present invention are achieved herein, where the invention relates to at least three, and preferably four, differently colored toners for use in developing a color image in the same image developing device, wherein each of the at least three differently colored toners comprises at least one binder and at least one colorant, and has substantially the same melt flow index value.

The toners are produced by individually producing each toner of the set so as to have substantially the same melt flow index value in a method comprised of:

(i) forming a toner by feeding at least one binder and at least one colorant into a mixing device to form a mixture, (ii) upon exit of the mixture from the mixing device, measuring a rheology property of the mixture with at least one monitoring device, and comparing the measured rheology property to a target property range that the measured rheology property must be within in order for the toner to achieve the desired melt flow index value, wherein if the measuring indicates that the rheology property is outside of the target property range, feed amounts of the at least one binder or of the at least one colorant into the mixing device are adjusted, (iii) grinding the mixture, optionally together with a portion of one or more external additives to be added to the mixture, (iv) classifying the ground mixture, (v) mixing the classified mixture with one or more external surface additives to obtain the toner having the desired melt flow index value, and (vi) repeating steps (i) to (v) for each additional differently colored toner desired to have the melt flow index value, thereby achieving at least three differently colored toners having substantially the same desired melt flow index value.

BRIEF DESCRIPTION OF THE DRAWING

The FIGURE is a graph depicting an example relationship between the amount of cross-linked resin and the amount of pigment in determining different MFI values of a developer.

DETAILED DESCRIPTION OF PREFERRED EMBODIMENTS

Figure 1:
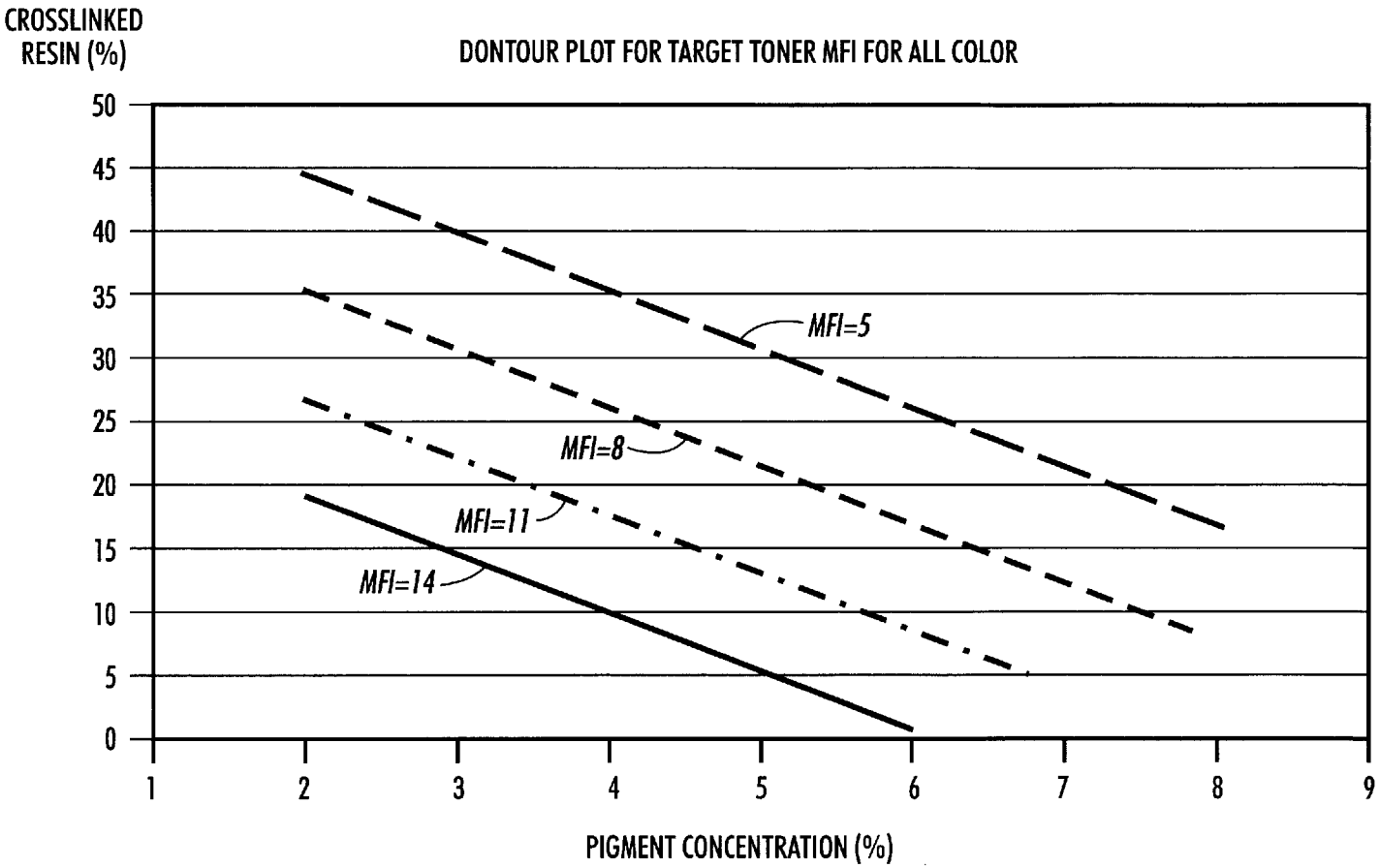

Generally, the process of electrophotographic printing includes charging a photoconductive member to a substantially uniform potential to sensitize the surface thereof. The charged portion of the photoconductive surface is exposed to a light image from, for example, a scanning laser beam, an LED source, etc., or an original document being reproduced. This records an electrostatic latent image on the photoconductive surface of the photoreceptor. After the electrostatic latent image is recorded on the photoconductive surface, the latent image is developed with toner.

In the present invention, two-component developer materials are used in the first step of the development process. A typical two-component developer comprises magnetic carrier granules having toner particles adhering triboelectrically thereto. The toner particles of the present invention exhibit negative triboelectric values. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. One type of color electrophotographic marking process, called image-on-image (IOI) processing, superimposes toner powder images of different color toners onto the photoreceptor prior to the transfer of the composite toner powder image onto the substrate. Typically, at least four color toners, mainly cyan, magenta, yellow and black, are used in developing the color image. While the 101 process provides certain benefits, such as a compact architecture, there are several challenges to its successful implementation. For instance, different color toners often contain differing amounts of colorants, etc., and thus it is difficult to ensure uniform color and/or gloss image quality for the entire color image.

By the present invention, the inventors have found that by carefully controlling the melt flow index values to be substantially the same for as many of the different color toners that develop a color image in the same device as possible, the resultant color image has an overall excellent image quality. In particular, the color image has an excellent overall gloss level and does not exhibit any differential gloss (distinctly different glosses among different colors) or gloss banding (variations in gloss from one area of an image to another within a single color).

"Substantially the same melt flow index values" refers to those differently colored toners to be used together in developing a color image that have melt flow index values within about 3 MFI units on either side of the desired melt flow index value.

The melt flow index (MFI) is a value identifying the rheology, or viscoelasticity, of the toner. MFI as used herein is defined as the weight of a toner (in grams) which passes through an orifice of length L and diameter D in a 10 minute period with a specified applied load. In the present invention, the conditions for determining the MFI of a toner are a temperature of 117° C., an applied load of 2.16 kilograms, and an L/D die ratio of 3.8. An MFI unit of 1 thus indicates that only 1 gram of the toner passes through the orifice under the specified conditions in 10 minutes time. "MFI units" as used herein thus refers to units of grams per 10 minutes.

A number of aspects of the overall print quality are affected by the rheology, or viscoelasticity, of the toners used to develop the print. The aspects of the overall print quality affected include overall gloss level of the image, the differential gloss of the image, both within a single color and color-to-color, the fix level of the image (for example as measured by either crease or rub testing) and color-to-color fix level differences, and image quality defects associated with offset of the image, either to the fusing roll during the fusing process (hot offset) or to other surfaces after the print has exited the machine (vinyl or document offset). In the present invention, the viscoelasticity is characterized by a single number, the melt flow index (MFI), as the melt flow index is on the first order an accurate reflection of the Theological properties which control the aspects of the print quality discussed above when the prints are fused using either a roll fusing system or a radiant fusing system.

Prior to the present invention, the MFI of a toner has merely been outcome dependent on the formulation of the toner, including the toner composition and the additive package. This has resulted in different toners that are to be used together in forming a color image having significantly different MFI values. These variable MFI values have resulted in a number of image quality shortfalls, particularly with respect to gloss and fix.

In the present invention, it has been found that the MFI values for as many of the toners as possible of a set of toners, preferably at least three toners out of a set of toners, more preferably all toners (typically four) out of a set of toners, should be substantially the same. It has also been found that the optimum MFI values vary depending on the type of imaging device used, more particularly depending on the type of fusing device used to fix the images to the image receiving substrate.

In a first embodiment of the present invention, the MFI value of at least three differently colored toners for use in a same image developing device is within the range of about 7±3 MFI units when the image developing device includes a radiant fusing device. Most preferably, the MFI values are 7±2 MFI units. Radiant fusing devices are non-contact fusing devices well known in the art in which heat is transmitted without physical contact of the heating element to toned image, that is, primarily through radiant heating and secondarily by the heat transfer though the air present between the heating element and the toned image in order to fuse the toner to the image receiving medium.

In a second embodiment of the present invention, the MFI value of at least three differently colored toners for use in a same image developing device is within the range of about 11±3 MFI units when the image developing device includes a roll fusing device. Most preferably, the MFI values are 11±1. Roll fusing devices are contact fusing devices that are also well known in the art, in which heat and pressure from the roll are used in order to fuse the toner to the image receiving medium.

In the present invention, any known type of image development system may be used, including, for example, magnetic brush development, jumping single-component development, hybrid scavengeless development (HSD), etc. These development systems are well known in the art, and further explanation of the operation of these devices to form an image is therefor not necessary here.

As mentioned previously, a set of toners for developing a color image typically includes at least the four traditional colors of black, cyan, magenta and yellow. Alternative colors may also be used. However, it has been found in the present invention that it is necessary for at least three of the toners from a set of toners used in developing a color image to have substantially the same MFI values in order to achieve overall excellent print quality as discussed above. For the traditional four color toner scheme, it has been found most preferable for at least cyan, magenta and black toners to have substantially the same MFI value. Yellow most preferably also has substantially the same MFI value, particularly in the embodiment in which a roll fusing device is used, but need not have substantially the same MFI value as the other toners of the set.

When the MFI values are all substantially the same for all of the toners of a set, the set is said to be color-blind.

The toners will now be further described in terms of the materials of the toners. As noted above, four different color toners, cyan (C), magenta (M), yellow (Y) and black (K), are typically used in developing full color images (although other color toners may also be used). Each of theses color toners in the present invention are preferably comprised of at least one resin binder, appropriate colorants and preferably also an additive package comprised of one or more additives. Suitable and preferred materials for use in preparing toners of the invention that possess the properties discussed above will now be discussed. The specific formulations used should not, however, be viewed as restricting the scope of the invention.

One of the two toner designs of the present invention is most preferably used in conjunction with an imaging device in which fusing is effected with a roll fusing device.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Furthermore, the above-mentioned polymer resins may also be crosslinked.

As one toner resin, there are selected polyester resins derived from a dicarboxylic acid and a diphenol. These resins are illustrated in U.S. Pat. No. 3,590,000, the disclosure of which is totally incorporated herein by reference. Also, polyester resins obtained from the reaction of bisphenol A and propylene oxide or propylene carbonate, and in particular including such polyesters followed by the reaction of the resulting product with fumaric acid (reference U.S. Pat. No. 5,227,460, the disclosure of which is totally incorporated herein by reference), and branched polyester resins resulting from the reaction of dimethylterephthalate with 1,3-butanediol, 1,2-propanediol, and pentaerythritol may also preferable be used.

Most preferred as the binder resin are polyester resins containing both linear portions and cross-linked portions of the type described in U.S. Pat. No. 5,227,460, discussed immediately above, i.e., polypropoxylated bisphenol A fumarate. These resins may be prepared by either reactive extrusion as described in the 460 Patent or liquid reactive extrusion as described in co-pending U.S. patent application No. 09/695,861 pending (incorporated herein by reference in its entirety). The cross-linked portion of the binder consists essentially of microgel particles with an average volume particle diameter up to 0.1 micron, preferably about 0.005 to about 0.1 micron, as determined by scanning electron microscopy and transmission electron microscopy, the microgel particles being substantially uniformly distributed throughout the linear portions. This resin may be prepared by a reactive melt mixing process as known in the art. The highly cross-linked dense microgel particles distributed throughout the linear portion impart elasticity to the resin, which improves the resin offset properties, while not substantially affecting the resin minimum fix temperature.

The toner resin is thus preferably a partially cross-linked unsaturated resin such as unsaturated polyester prepared by cross-linking a linear unsaturated resin (hereinafter called base resin) such as linear unsaturated polyester resin, preferably with a chemical initiator, in a melt mixing device such as, for example, an extruder at high temperature (e.g., above the melting temperature of the resin and preferably up to about 150° C. above that melting temperature) and under high shear.

The toner resin has a weight fraction of the microgel (gel content) in the resin mixture in the range typically from about 0.5 to about 20 weight percent, more preferably about 0.5 to about 15 weight percent, most preferably about 0.8 to 12 weight percent. The linear portion is comprised of base resin, preferably unsaturated polyester, in the range from about 80 to about 98 percent by weight of said toner resin. The linear portion of the resin preferably comprises low molecular weight reactive base resin that did not cross-link during the cross-linking reaction, preferably unsaturated polyester resin.

The molecular weight distribution of the resin is thus bimodal, having different ranges for the linear and the cross-linked portions of the binder. The number-average molecular weight (Mn) of the linear portion as measured by gel permeation chromatography (GPC) is in the range of from, for example, about 1,000 to about 20,000, and preferably from about 3,000 to about 8,000. The weight-average molecular weight (Mw) of the linear portion is in the range of from, for example, about 2,000 to about 40,000, and preferably from about 5,000 to about 20,000. The weight average molecular weight of the gel portions is, on the other hand, generally greater than 1,000,000. The molecular weight distribution (Mw/Mn) of the linear portion is in the range of from, for example, about 1.5 to about 6, and preferably from about 1.8 to about 4. The onset glass transition temperature (Tg) of the linear portion as measured by differential scanning calorimetry (DSC) is in the range of from, for example, about 50° C. to about 70° C.

This binder resin can provide a low melt toner with a minimum fix temperature of from about 100° C. to about 200° C., preferably about 100° C. to about 160° C., more preferably about 110° C. to about 140° C., provide the low melt toner with a wide fusing latitude to minimize or prevent offset of the toner onto the fuser roll, and maintain high toner pulverization efficiencies. The toner resins and thus toners show minimized or substantially no vinyl or document offset.

In a preferred embodiment, the cross-linked portion consists essentially of very high molecular weight microgel particles with high density cross-linking (as measured by gel content) and which are not soluble in substantially any solvents such as, for example, tetrahydrofuran, toluene and the like. The microgel particles are highly cross-linked polymers with a very small, if any, cross-link distance. This type of cross-linked polymer may be formed by reacting chemical initiator with linear unsaturated polymer, and more preferably linear unsaturated polyester, at high temperature and under high shear. The initiator molecule breaks into radicals and reacts with one or more double bond or other reactive site within the polymer chain forming a polymer radical. This polymer radical reacts with other polymer chains or polymer radicals many times, forming a highly and directly cross-linked microgel. This renders the microgel very dense and results in the microgel not swelling very well in solvent. The dense microgel also imparts elasticity to the resin and increases its hot offset temperature while not affecting its minimum fix temperature.

In a most preferred embodiment of the present invention, the toner binder resin comprises a melt extrusion of (a) linear propoxylated bisphenol A fumarate resin and (b) this resin cross-linked by reactive extrusion of this linear resin, with the resulting extrudate comprising a resin with an overall gel content of from about 0.8 to about 12 weight percent. Linear propoxylated bisphenol A fumarate resin is available under the tradename SPARII from Resana S/A Industrias Quimicas, Sao Paulo Brazil, or as Neoxyl P2294 or P2297 from DSM Polymer, Geleen, The Netherlands, for example.

Chemical initiators such as, for example, organic peroxides or azo-compounds are preferred for making the cross-linked toner resins of the invention. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di (2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di (benzoyl peroxy) hexane, oo-t-butyl o-(2-ethyl hexyl) mono peroxy carbonate, and oo-t-amyl o-(2-ethyl hexyl) mono peroxy carbonate, alkyl peroxides such as, for example, dicumyl peroxide, 2,5-dimethyl 2,5-di (t-butyl peroxy) hexane, t-butyl cumyl peroxide, bis(tbutyl peroxy) diisopropyl benzene, di-t-butyl peroxide and 2,5-dimethyl 2,5-di (t-butylperoxy) hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di (t-butyl peroxy) valerate, 1,1-di (t-butyl peroxy) 3,3,5-trimethyl cyclohexane, 1,1-di (t-butyl peroxy) cyclohexane, 1,1-di (t-amyl peroxy) cyclohexane, 2,2-di (t-butyl peroxy) butane, ethyl 3,3-di (t-butyl peroxy) butyrate, ethyl 3,3-di (t-amyl peroxy) butyrate and 1,1-bis (t-butyl(peroxy) 3,3,5-trimethylcyclohexane. Suitable azo-compounds include azobis-isobutyronitrile, 2,2'-azobis (isobutyronitrile), 2,2'-azobis (2,4-dimethyl valeronitrile), 2,2'-azobis (methyl butyronitrile), 1,1'-azobis (cyano cyclohexane) and other similar known compounds.

A reactive melt mixing process is a process wherein chemical reactions can be carried out on the polymer in the melt phase in a melt mixing device, such as an extruder. In preparing the toner resins, these reactions are used to modify the chemical structure and the molecular weight, and thus the melt rheology and fusing properties, of the polymer. Reactive melt mixing is particularly efficient for highly viscous materials, and is advantageous because it requires no solvents, and thus is easily environmentally controlled. As soon as the amount of cross-linking desired is achieved, the reaction products can be quickly removed from the reaction chamber.

The resins are generally present in the toner of the invention in an amount of from about 40 to about 98 percent by weight, and more preferably from about 70 to about 98 percent by weight, although they may be present in greater or lesser amounts, provided that the objectives of the invention are achieved.

The toner resins can be subsequently melt blended or otherwise mixed with a colorant (e.g., pigment or dye), charge carrier additives, surfactants, emulsifiers, pigment dispersants, flow additives, embrittling agents, and the like. The resultant product can then be pulverized by known methods such as milling to form toner particles. If desired, waxes with a molecular weight of from about 1,000 to about 7,000, such as polyethylene, polypropylene, and paraffin waxes, can be included in, or on the toner compositions as fusing release agents.

Various suitable colorants of any color without restriction can be employed in toners of the invention, including suitable colored pigments, dyes, and mixtures Sunbrite Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Cinquassi Green, Hostaperm Green, titanium dioxide, cobalt, nickel, iron powder, Sicopur 4068 FF, and iron oxides such as Mapico Black (Columbia), NP608 and NP604 (Northern Pigment), Bayferrox 8610 (Bayer), M08699 (Mobay), TMB-100 (Magnox), mixtures thereof and the like.

The colorant, preferably black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 9 percent by weight for color toner and about 3 to about 60 percent by weight for black toner.

For the black toner of the invention, in a most preferred embodiment, carbon black is used at a loading of 5% by weight. Carbon black is preferred.

For the cyan toner of the invention, in a most preferred embodiment, the pigment is comprised of 30% PV Fast Blue (Pigment Blue 15:3) from SUN dispersed in 70% linear propoxylated bisphenol A fumarate and is loaded into the toner in an amount of 11% by weight (corresponding to about 3.3% by weight pigment loading).

For the yellow toner of the invention, in a most preferred embodiment, the pigment is comprised of 30% Sunbrite Yellow (Pigment Yellow 17) from SUN dispersed in 70% linear propoxylated bisphenol A fumarate and is loaded into the toner in an amount of about 27% by weight (corresponding to about 8% by weight pigment loading).

For the magenta toner of the invention, in a most preferred embodiment, the pigment is comprised of 30 Fanal Pink (Pigment Red 81:2) from SUN dispersed in 70% linear propoxylated bisphenol A fumarate and is loaded into the toner in an amount of about 16% by weight (corresponding to about 4.7% by weight pigment loading).

Any suitable surface additives may be used in the present invention. Most preferred in the present invention are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as Unilin 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability.

The $SiO_2$ and $TiO_2$ should preferably have a primary particle size greater than approximately 30 nanometers, preferably of at least 40 nm, with the primary particles size measured by, for instance transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are preferably applied to the toner surface with the total coverage of the toner ranging from, for example, about 100 to 200% theoretical surface area coverage (SAC), where the theoretical SAC (hereafter referred to as SAC) is calculated assuming all toner particles are spherical and have a diameter equal to the volume median diameter of the toner as measured in the standard Coulter counter method, and that the additive particles are distributed as primary particles on the toner surface in a hexagonal closed packed structure.

The most preferred $SiO_2$ and $TiO_2$ have been surface treated with compounds including DTMS (dodecyltrimethoxysilane) or HMDS (hexamethyldisilazane). Examples of these additives are: NA50HS silica, obtained from DeGussa/Nippon Aerosil Corporation, coated with a mixture of HMDS and aminopropyltriethoxysilane; DTMS silica, obtained from Cabot Corporation, comprised of a fumed silica, for example silicon dioxide core L90 coated with DTMS; H2050EP silica, obtained from Wacker Chemie, coated with an amino flnctionalized organopolysiloxane; TS530 from Cabot Corporation, Cab-O-Sil Division, a treated fumed silica; SMT5103 titania, obtained from Tayca Corporation, comprised of a crystalline titanium dioxide core MT500B, coated with DTMS.; MT3103 titania, obtained from Tayca Corporation, comprised of a crystalline titanium dioxide core coated with DTMS. The titania may also be untreated, for example P-25 from Nippon Aerosil Co., Ltd.

Zinc stearate is preferably also used as an external additive for the toners of the invention, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate known as Zinc Stearate L, obtained from Ferro Corporation, which has an average particle diameter of about 9 microns, as measured in a Coulter counter.

Preferably, the toners contain from, for example, about 0.1 to 5 weight percent titania, about 0.1 to 8 weight percent silica and about 0.1 to 4 weight percent zinc stearate. More preferably, the toners contain from, for example, about 0.1 to 3 weight percent titania, about 0.1 to 6 weight percent silica and about 0.1 to 1 weight percent zinc stearate.

The additives discussed above are chosen to enable superior toner flow properties, as well as high toner charge and charge stability. The surface treatments on the $SiO_2$ and $TiO_2$, as well as the relative amounts of the two additives, can be manipulated to provide a range of toner charge.

For further enhancing the negative charging characteristics of the developer compositions described herein, and as optional components there can be incorporated into the toner or on its surface charge enhancing additives inclusive of aluminum complexes, like BONTRON E-88, and the like and other similar known charge enhancing additives. Also, positive charge enhancing additives may also be selected, such as alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like. These additives may be incorporated into the toner in an amount of from about 0.1 percent by weight to about 20 percent by weight, and preferably from 1 to about 3 percent by weight.

In the present invention, it has been found that several components contribute to the overall MFI value of the toner. A first contributor is the amount of cross-linking present in the binder resin. As the amount of cross-linked (or gel) portions increases, the MFI value decreases. Further, as the amount of colorant in the toner increases, the MFI value decreases. The additive package used, and amount used, also effects the MFI value of the toner. In general, the greater the amount of external additives, the lesser the MFI value of the toner. There are thus several variables of the composition which may be manipulated in order to adjust the MFI value of the toner to a desired value. These compositional variables may also be used to compensate for variations in the MFI of the toner caused by variation in the raw materials used to make the toners, specifically gel content variations in the crosslinked portion of the resin or molecular weight variations in the linear portion of the resin, or variations in the manufacturing process, specifically energy input to the toner during one of the processing unit operations.

As mentioned above, for toners to be used with an imaging device including a roll fusing device, the melt flow index value of at least three of the toners of the set of toners is about 11±3 MFI, most preferably about 11±1 MFI units.

Preferably, the at least three color toners in this embodiment that have substantially the same MFI value are black, cyan and magenta. However, it is most preferred in this embodiment that yellow also have substantially the same MFI value as the other toners of the set. This is because the roll fuser contacts the toner during fusing, and thus gloss differentials among the different toners can become quite evident. Substantially matching the MFI values for all of the toners of the set eliminates gloss differentials and achieves a very high quality image with an excellent overall gloss level.

Another toner design of the present invention is most preferably used in conjunction with an imaging device in which fusing is effected with a radiant fusing device. In this second toner design, all of the same binders, colorants, additives, etc. may be selected as extensively discussed above.

In particular to the binder, the binder preferably also here comprises a propoxylated bisphenol A fumarate resin with both cross-linked and linear portions. However, the amount of cross-linked, or gel, portions in this second embodiment is most preferably from about 9 to about 18 percent by weight of the resin. Specifically, the amount of gel portions for black, cyan and magenta toners may be around 13 percent by weight of the resin, while the yellow toner preferably contains no gel portions (as a result of the yellow toner requiring higher colorant amounts). These toners are described extensively in U.S. patent application No. 09/520,360, filed Mar. 7, 2000 and incorporated by reference herein in its entirety.

In this embodiment, at least three of the toners used in forming a color image have substantially the same MFI value of about 7±3 MFI units, most preferably of about 7±2 MFI units. Preferably, the at least three toners comprise at least cyan, magenta and black toners. Due to the high pigment loading, it is difficult to achieve a similar MFI value for yellow toner. Thus, although it may be possible to obtain the same MFI value for a yellow toner, such is not required. Because of the combination of the order in which the colors are present on the paper as it enters the fuser (specifically, yellow is the toner layer nearest to the paper) and the use of radiant fusing, the gloss differential resulting from the use of a different MFI value yellow toner in minimized. A radiant fuser is a very low shear device, that is there is no shear force present on the toner layers to mix the toner particles, and therefore the image gloss is largely determined by the toner which is present on the top surface of the image. Therefore, differential gloss could be present only in the rare case in which a region of the image consist of pure yellow toner, particularly when this region is directly adjacent to a region of the image which contains two or more toner layers. Further, due to the low sensitivity of the human eye to yellow images, this specific instance of differential gloss would be difficult to detect by a human observer with the cyan, magenta, and black toners of the present invention.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion.

The toner is preferably made by first mixing the binder, preferably comprised of both the linear resin and the cross-linked resin as discussed above, and the colorant together in a mixing device, preferably an extruder, and then extruding the mixture. The extruded mixture is then preferably micronized in a grinder along with about 0.3 to about 0.5 weight percent of the total amount of silica to be used as an external additive. The toner is then classified to form a toner with the desired volume median particle size and percent fines as discussed above. Care should also be taken in the method in order to limit the coarse particles, grits and giant particles. Subsequent toner blending of the remaining external additives is preferably accomplished using a mixer or blender, for example a Henschel mixer, followed by screening to obtain the final toner product.

In a most preferred embodiment, the process is carefully controlled and monitored in order to consistently achieve toners having the desired MFI values discussed above. First, the ingredients are fed into the extruder in a closed loop system from hoppers that preferably separately contain, respectively, the linear resin, the cross-linked resin (i.e., the partially cross-linked resin with cross-linked gel particles therein), the predispersed pigment (i.e., the pigment dispersed in a portion of binder such as linear propoxylated bisphenol A fumarate) and reclaimed toner fines.

Reclaimed toner fines are those toner particles that have been removed from previously made toner during classification as being too small. As this can be a large percentage of material, it is most preferred to recycle this material back into the method as reclaimed toner fines. This material thus already contains the resins and the colorant, as well as any additives introduced into the toner at the extrusion, grinding, or classification processes. It may comprise anywhere from about 5 to about 50% by weight of the total material added into the extruder.

As the extrudate passes through the die, it is monitored with one or more monitoring devices that can provide feedback signals to control the amounts of the individual materials added into the extruder so as to carefully control the composition and properties of the toner, and thus ensure that a consistent product is obtained.

The extrudate is monitored with at least an on-line rheometer. The on-line rheometer evaluates the melt rheology of the product extrudate and can provide a feedback signal to control the amount of linear and cross-linked resin being dispensed, the amount of colorant being dispersed, and/or the amount of toner fines being dispersed. The melt rheology measured can be any metric associated with the MFI of the toner, and need not measure the MFI value directly. For example, the rheometer can measure the apparent viscosity of the toner exiting the extruder. For each toner, a correlation can readily be developed by a practitioner in the art between the metric measured and the MFI value. Thus, for the toner being prepared, if the melt rheology measured is too high to achieve an MFI value within the desired range, the signal indicates that steps should be taken to decrease the MFI value, for example by decreasing the amount of linear resin added relative to the cross-linked resin.

For example, as depicted in the Figure, a relationship can readily be developed between the amount of cross-linked resin and the amount of pigment in a developer as they relate to the MFI of the developer. As shown in the FIGURE, in general, as the amount of cross-linked resin is increased, the MFI increases, and as the amount of pigment present is increased, the MFI increases, leading to a nearly linear relationship among these values as depicted in the FIGURE.

It should be noted that because the presence of the external additives acts to decrease the MFI value of the end toner as discussed above, the target MFI value for the toner exiting the extruder will be higher than for the end toner. As the amount and type of external additives for each toner color is consistent, one of ordinary skill in the art can readily determine the extent to which the MFI value will drop for a given toner once the external additive package is added to the toner. Accordingly, the target MFI value for the materials exiting the extruder can be appropriately set to a range above the end MFI value so that once the external surface additives are added, the toner should exhibit an MFI value within the desired end range.

In grinding, the addition of a portion of the total amount of silica to be added facilitates the grind and class operations. Specifically, injection into the grinder of between 0.1 and 1.0% of a silica or metal oxide flow aid decreases the level of variability in the output of the grinding operation, allowing better control of the grinding process and allowing it to operate at an optimized level. Additionally, this process enhances the jetting rate of the toner by between 10 and 20 percent.

Classified toner product is then blended with the external surface additives in a manner to enable even distribution and firm attachment of the surface additives, for example by using a high intensity blender. The blended toner achieved has the appropriate level and stability of toner flow and triboelectric properties.

The resulting toner particles can then be formulated into a developer composition. Preferably, the toner particles are mixed with carrier particles to achieve a two-component developer composition. Preferably, the toner concentration in each developer ranges from, for example, 1 to 10%, more preferably 2 to 8%, by weight of the total weight of the developer.

Illustrative examples of carrier particles that can be selected for mixing with the toner composition prepared in accordance with the present invention include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluoroethylenes, other known coatings and the like.

For the set of toners of the present invention to be used in conjunction with a roll fusing device, in the most preferred embodiment the carrier core is partially coated with a polymethyl methacrylate (PMMA) polymer having a weight average molecular weight of 300,000 to 350,000 commercially available from Soken. The PMMA is an electropositive polymer in that the polymer that will generally impart a negative charge on the toner with which it is contacted. The coating preferably has a coating weight of from, for example, 0.1 to 3.0% by weight of the carrier, preferably 0.5 to 1.3% by weight.

For the set of toners of the present invention to be used in conjunction with a radiant fusing device, in the most preferred embodiment the carrier core is coated with a mixture of at least two dry polymer components, which dry polymer components are preferably not in close proximity thereto in the triboelectric series, and most preferably of opposite charging polarities with respect to the toner selected. The electronegative polymer, i.e., the polymer that will generally impart a positive charge on the toner which it is contacted with, is preferably comprised of a polyvinylidenefluoride polymer or copolymer. Such polyvinylidenefluoride polymers are commercially available, for example under the tradename Kynar from Pennwalt. Kynar 301F is polyvinylidenefluoride and Kynar 7201 is copolyvinylidenefluoride tetrafluoroethylene. The electropositive polymer, i.e., the polymer that will generally impart a negative charge on the toner which it is contacted with, is preferably comprised of a polymethyl methacrylate (PMMA) polymer having a weight average molecular weight of 300,000 to 350,000 commercially available from Soken. The percentage of each polymer present in the carrier coating mixture can vary depending on the specific components selected, the coating weight and the properties desired. Generally, the coated polymer mixtures used contain from about 3 to about 97 percent of the electronegative polymer, and from about 97 to about 3 percent by weight of the electropositive polymer. Most preferably, there are selected mixtures of polymers with from about 5 to 20 percent by weight of the electronegative polymer, and from about 80 to 95 percent by weight of the electropositive polymer. The coating preferably has a coating weight of from, for example, 0.1 to 3.0% by weight of the carrier, preferably 0.1 to 1.0% by weight.

The PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylarninoethyl methacrylate, and the like.

The carrier particles may be prepared by mixing the carrier core with from, for example, between about 0.05 to about 10 percent by weight, more preferably between about 0.05 percent and about 3 percent by weight, based on the weight of the coated carrier particles, of polymer in until adherence thereof to the carrier core by mechanical impaction and/or electrostatic attraction.

The polymer is most preferably applied in dry powder form and having an average particle size of less than 1 micrometer, preferably less than 0.5 micrometers. Various effective suitable means can be used to apply the polymer to the surface of the carrier core particles. Examples of typical means for this purpose include combining the carrier core material and the polymer by cascade roll mixing, or tumbling, milling, shaking, electrostatic powder cloud spraying, fluidized bed, electrostatic disc processing, and with an electrostatic curtain.

The mixture of carrier core particles and polymer is then heated to a temperature below the decomposition temperature of the polymer coating. For example, the mixture is heated to a temperature of from about 90° C. to about 350° C., for a period of time of from, for example, about 10 minutes to about 60 minutes, enabling the polymer to melt and fuse to the carrier core particles. The coated carrier particles are then cooled and thereafter classified to a desired particle size.

In a further most preferred embodiment for the set of toners of the present invention to be used in conjunction with a roll fusing device, the polymer coating of the carrier core is comprised of PMMA, most preferably PMMA applied in dry powder form and having an average particle size of less than 1 micrometer, preferably less than 0.5 micrometers, that is applied (melted and fused) to the carrier core at higher temperatures on the order of 220° C. to 260° C. Temperatures above 260° C. may adversely degrade the PMMA. Triboelectric tunability of the carrier and developers of the invention is provided by the temperature at which the carrier coating is applied, higher temperatures resulting in higher tribo up to a point beyond which increasing temperature acts to degrade the polymer coating and thus lower tribo.

The carrier particles can be mixed with the toner particles in various suitable combinations. However, best results are obtained when about 1 part to about 5 parts by weight of toner particles are mixed with from about 10 to about 300 parts by weight of the carrier particles.

EXAMPLE 1

In this Example, gloss values for toners of the invention to be used in conjunction with a roll fusing device are evaluated. The set of toners evaluated consist of a cyan, a magenta, a black, and a yellow toner with melt flow index values of 11.0, 10.6, 10.9, and 8.5 respectively. All toners are composed of (1) polyester resins containing both linear portions and cross-linked portions of the polypropoxylated bisphenol A fumarate type, with the cross-linked portion prepared by liquid reactive extrusion, and (2) a pigment, with the pigment consisting of 3.3% PB15:3 for the cyan toner, 4.7% PR81:2 for the magenta toner, 5% carbon black for the black toner, and 8.0% PY17 for the yellow toner. The ratio of the linear and cross-linked portions of the resin is adjusted to give extrudate MFI values of 14.3, 16.6, 16.0, and 12.5 for the cyan, magenta, black, and yellow toner, respectively. These values are near the values from the model developed to correlate the extruded toner MFI to the end toner MFI which are predicted to yield final blended toners with MFI values of 11, 11, 11, and 8 for the cyan, magenta, black, and yellow toner, respectively. Each toner is then blended with an external additive package consisting of a treated titania, Zinc Stearate-L, and either a single treated silica in the case of the magenta or black toner or a combination of two treated silicas in the case of the yellow and cyan toners.

Developers are then made from these toners by combining them with a carrier consisting of 1% polymethylmethacrylate coated onto a 77 micron diameter atomized steel core. These developers are run in a xerographic device running in discharged area development only and using a hybrid scavengeless development subsystem (see U.S. Pat. No. 4,868, 600). Images are developed and the gloss levels of the resulting toned images are determined using the Gardiner Gloss Meter, which is the industry standard light reflection measurement. At a fuser temperature of 360° F., the gloss levels for the toners are 56, 65, 55, and 54 for cyan, magenta, black and yellow, respectively.

Therefore these toners, in which the magenta, cyan, and black toners have MFI values which are essentially constant, display gloss levels which are independent of color.

COMPARATIVE EXAMPLE 1

In this Example, gloss values for toners to be used in conjunction with a roll fusing device are evaluated. The set of toners evaluated consist of a cyan, a magenta, a black, and a yellow toner with melt flow index values of 15, 9, 10, and 6 respectively. All toners are composed of (1) polyester resins containing both linear portions and cross-linked portions of the polypropoxylated bisphenol A fumarate type, with the cross-linked portion prepared by reactive extrusion, and (2) a pigment, with the pigment consisting of 3.3% PB 15:3 for the cyan toner, 4.7% PR81:2 for the magenta toner, 5% carbon black for the black toner, and 8.0% PY17 for the yellow toner. The ratio of the linear and cross-linked portions of the resin is held constant to yield finished toners with gel concentration of 5 percent by weight. Each toner is then blended with an external additive package consisting of a treated titania, Zinc Stearate-L, and either a single treated silica in the case of the magenta or black toner or a combination of two treated silicas in the case of the yellow and cyan toners. In all cases the external additive package and processing conditions are identical to those in Example 1.

Developers are then made from these toners by combining them with a carrier consisting of 1% polymethylmethacrylate coated onto a 77 micron diameter atomized steel core. These developers are run in a xerographic device running in discharged area development only and using a hybrid scavengeless development subsystem (see U.S. Pat. No. 4,868, 600). Images are developed and the gloss levels of the resulting toned images are determined using the Gardiner Gloss Meter, which is the industry standard light reflection measurement. At a fuser temperature of 360F, the gloss levels for the toners are 69, 62, 50, and 38 for cyan, magenta, black and yellow, respectively.

Therefore these toners, in which the magenta, cyan, and black toners have constant levels of gel but variable MFI values, display gloss levels which are not independent of color.

Although the invention has been described with reference to specific preferred embodiments, it is not intended to be limited thereto. Rather, those having ordinary skill in the art will recognize that variations and modifications may be made therein which are within the spirit of the invention and within the scope of the claims.

What is claimed is:

1. At least three differently colored toners for use in a same image developing device, wherein each of the at least three differently colored toners comprises at least one binder and at least one colorant, and has substantially the same melt flow index value, wherein the melt flow index value is about 7±3 MFI units when the image developing device includes a radiant fusing device and is about 11±3 MFI units when the image developing device includes a roll fusing device.

2. The at least three differently colored toners according to claim 1, wherein the melt flow index value is about 7±2 MFI units when the image developing device includes a radiant fusing device.

3. The at least three differently colored toners according to claim 1, wherein the differently colored toners are cyan, magenta and black toners.

4. The at least three differently colored toners according to claim 3, wherein when the image developing device includes a radiant fusing device, the at least one binder of each of the toners comprises a propoxylated bisphenol A fumarate resin having a gel content of from about 9 to about 18 percent by weight of the resin.

5. The at least three differently colored toners according to claim 1, wherein each of the toners further comprises one or more external surface additives of silicon dioxide powder, a metal oxide powder or a lubricating agent.

6. The at least three differently colored toners according to claim 5, wherein the metal oxide powder is titanium dioxide or aluminum oxide and the lubricating agent is zinc stearate.

7. The at least three differently colored toners according to claim 1, wherein the melt flow index value is about 11±1 MFI units when the image developing device includes a roll fusing device.

8. The at least three differently colored toners according to claim 3, wherein the differently colored toners further include a yellow toner.

9. The at least three differently colored toners according to claim 1, wherein when the image developing device includes a roll fusing device, the at least one binder of each of the toners comprises a propoxylated bisphenol A fumarate resin and the resin has an overall gel content of from about 0.8 to about 12 percent by weight of the binder.

10. A method of producing at least three differently colored toners for use in a same image developing device, wherein each of the at least three differently colored toners comprises at least one binder and at least one colorant, and has substantially a same desired melt flow index value, the method comprising (i) forming a single toner by feeding at least one binder and at least one colorant into a mixing device to form a mixture, (ii) upon exit of the mixture from the mixing device, measuring a rheology property of the mixture with at least one monitoring device, and comparing the measured rheology property to a target property range that the measured rheology property must be within in order for the single toner to achieve the desired melt flow index value, wherein if the measuring indicates that the rheology property is outside of the target property range, feed amounts of the at least one binder or of the at least one colorant into the mixing device are adjusted, (iii) grinding the mixture, optionally together with a portion of one or more external additives to be added to the mixture, (iv) classifying the ground mixture, (v) mixing the classified mixture with one or more external surface additives to obtain the single toner having the desired melt flow index value, and (vi) repeating steps (i) to (v) for each additional differently colored toner of the at least three differently colored toners, thereby achieving the at least three differently colored toners having substantially the same desired melt flow index value, wherein the measured rheology property is correlated to a melt flow index value of about 7±3 MFI units when the image developing device includes a radiant fusing device and is correlated to a melt flow index value of about 11±3 MFI units when the image developing device includes a roll fusing device.

11. The method according to claim 10, wherein the mixing device comprises an extruder.

12. The method according to claim 10, wherein the at least one measuring device provides a feedback signal to control the feeding of the at least one binder or of the at least one colorant.

13. The method according to claim 10, wherein the at least one measuring device comprises an on-line rheometer to measure a melt rheology of the mixture.

14. The method according to claim 10, wherein the feeding further comprises feeding reclaimed toner fines into the mixing device.

15. The method according to claim 10, wherein the at least one binder comprises both a linear propoxylated bisphenol A fumarate and a cross-linked propoxylated bisphenol A fumarate which are fed into the mixing device from separate containers.

16. The method according to claim 15, wherein the adjusting of the feed amounts comprises adjusting a feed ratio of the linear propoxylated bisphenol A fumarate to the cross-linked propoxylated bisphenol A fumarate.

17. The method according to claim 10, wherein the differently colored toners are cyan, magenta and black toners.

18. The method according to claim 17, wherein the differently colored toners further include a yellow toner.

19. The method according to claim 10, wherein the method further comprises mixing the toner with carrier particles to obtain a two-component developer.

20. At least three differently colored toners for use in a same image developing device, wherein each of the at least three differently colored toners comprises at least one binder including both linear portions and crosslinked portions and at least one color ink, and wherein each of the at least three differently colored toners has substantially the same melt flow index value, wherein the melt flow index value is about 7±3 MFI units when the image developing device includes a radiant fusing device and is about 11±3 MFI units when the image developing device includes a roll fusing device.

* * * * *